US005755117A

United States Patent [19]

Shenhav

[11] Patent Number: 5,755,117

[45] Date of Patent: May 26, 1998

[54] METAL MOUNT FOR CUT JEWELS, AND ACCESSORIES

[75] Inventor: Eran Shenhav, Pforzheim, Germany

[73] Assignee: Feeling the Collection Schmuckwaren GmbH, Pforzheim, Germany

[21] Appl. No.: 890,902

[22] Filed: Jul. 10, 1997

Related U.S. Application Data

[63] Continuation of Ser. No. 676,408, Jul. 8, 1996, abandoned.

[30] Foreign Application Priority Data

Feb. 14, 1996 [JP] Japan ..... 8-051090

[51] Int. Cl.[6] ..... A44C 17/02

[52] U.S. Cl. ..... 63/26; 63/29.1; 63/23

[58] Field of Search ..... 63/21, 23, 26, 63/27, 29, 29.1, 32; 29/10

[56] References Cited

U.S. PATENT DOCUMENTS 5,090,217 2/1992 Beber et al. ..... 63/27
5,339,655 8/1994 Grando ..... 63/26 X
5,479,795 1/1996 Neri ..... 63/26 X

FOREIGN PATENT DOCUMENTS 63-199610 8/1988 Japan .
5-37041 2/1993 Japan .
5-37041 6/1993 Japan .
6-8730 3/1994 Japan .

OTHER PUBLICATIONS

Les Joyaux Magazine, Jul. 1985, p. 112.
Les Joyaux Magazine, May 1986, p. 112.

*Primary Examiner*—Kien T. Nguyen
*Attorney, Agent, or Firm*—Oliff & Berridge, PLC

[57] ABSTRACT

The metal mount comprises a laterally viewing U-letter figured metal base 1 having an upper leg portion 2 and a lower leg portion 3, a hole 5 is provided on the end of the lower leg portion 3 and inside the curved portion of the U-letter figured metal base 1 a cylinder 4 is mounted in a unitary manner. As an accessory 15, a jewel 12 is fit between the upper leg portion 2 and the lower leg portion 3. A string like 16 is inserted into the cylinder 4.

7 Claims, 4 Drawing Sheets

METAL MOUNT FOR CUT JEWELS, AND ACCESSORIES

This is a continuation of application Ser. No. 08/676.408 filed 07/08/96 now abandoned.

BACKGROUND OF THE INVENTION

1. Field of the Invention

The present invention relates to a metal mount for jewels (hereinafter referred to as "cut jewel") that have been cut having a flat upper surface and a conical or pyramidal portion on a lower surface, and a personal ornament or accessories in which said cut jewels are fit particularly for a pendant for necklace.

2. Description of the Prior Art

The cut jewels having a flat upper surface and a conical or pyramidal portion on a lower surface, such as facet cut jewels or brilliant cut jewels, are fixed in such a manner as a plurality of nails (fasteners) protruding upward from a base can grip the crown or bezel of the cut jewel and press the cut jewel against the base. In order to produce metals having such mounting structures, it needs much skilled technique of craftsmen. In addition, special metal mounts have to be prepared depending on the size and shape of each cut jewel. Further, in the case of metal mounts having clip-like fasteners, it is relatively troublesome that every fastener is apt to be bent when being subjected to some inadvertent loads (impact), for instance, by being caught by clothes, and that the jewel is threatened to be lost. Furthermore, the incident rays from outside may be reduced by covering due to the existence of the metal mount and the nails on the lower surface (pavilion) of the cut jewel.

To solve the above problem, a structure for mounting cut jewels has been proposed, which comprises a bracket with a hole for receiving the culet and the tip end of the pavilion of the jewel and a nail protruding upward from one end of the bracket to reach the girdle of the jewel and to cover at least one corner of both the crown and the girdle and having two working sections (see Laid-open Utility Model Sho 63-199.610).

This improved mounting structure grips a cut jewel at three points, that is, the hole and two working sections of the nail. This structure has an advantage that it receives more incident rays than in the prior art to improve the brightness of the jewel because the smaller number of nails serve to expose the lower portion (pavilion) of the jewel. Since, however, this structure uses the nail to press the crown, the crown is retained properly if the nail has an angle smaller than 45° that is an ideal angle, but it is threatened to fall if the angle becomes larger than 45°. In this case, the need to increase the interval between working sections forces the structure to have a large width, but the allowable width is restricted due to design limitations. In addition, the mounting is complicated because the nail must be positioned so as to correspond to the cut surface (a bezel facet or an upper girdle facet) constituting the crown.

In order to solve the above problem, the invention described in Japanese Patent Publication Hei 5-37041 has been proposed. The invention described in the publication discloses a metal mount of cut jewels and accessories, wherein a lower portion of the cut jewel is exposed and a flat upper surface of the cut jewel, which is not affected by the angle of a crown and the cut surface constituting the crown, is a portion to be fixed. The present invention is made further to improve the invention described in Japanese Patent Publication Hei 5-37041, to make use of it mainly for cut pendants, in addition to provide metal mounts and accessories which can be arranged widely in designing point of view.

SUMMARY OF THE INVENTION

The present invention is a metal mount for cut jewels having a plane portion on upper surface and a conical portion on the lower surface, which consists of a strip of metal base having narrowed width and a laterally viewing U-letter figured shape with an upper leg portion and a lower leg portion, on the inside end of the lower leg portion opposing the upper leg portion is provided with a hole in which the conical tip of the conical portion of the cut jewel is inserted, and on the inside of the laterally U-letter curved portion a cylinder is provided in a unitary manner to be in contact with the conical portion of the cut jewel.

Further, the present invention is an accessory which comprises a laterally viewing U-letter figured shape of strip of metal base with an upper leg portion and a lower leg portion, on the inside of the tip end of the lower leg portion a hole is provided and a cylinder is provided on the inside of the curved portion of the metal base to form a metal mount, and a cut jewel being fit in the hole of the lower leg portion with its tip end of the conical portion and under the inner surface of the upper leg portion with its upper plane portion while the side of the conical portion being in contact with the cylinder.

Since the present invention is constituted as the above, a cut jewel can be easily fit, as an accessory, by inserting a string-like such as necklace chain into the cylinder a necklace can be obtained, and since the cut jewel is fixed merely by a strip of metal base having narrowed width and laterally viewing U-letter figured shape, other ornaments can be attached thereto. Further, the width of the metal base having laterally viewing U-letter figured shape is necessary to be less than the diameter of the table of the jewel. And, the length of the cylinder which is fastened in a unit on the inside of the curved portion of the metal base having laterally viewing U-letter figured shape is preferably identical with the width of the metal base.

The cylinder fixed in a unit with the metal base may be attached by welding or being formed from the metal base itself.

DETAILED EXPLANATION OF THE EMBODIMENT

Figure 1:
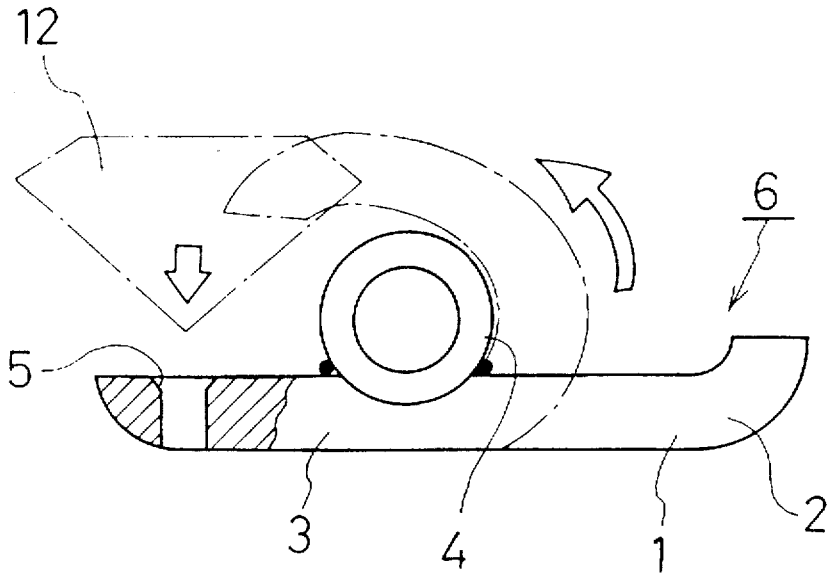
FIG. 1 is a side view of a metal base of the embodiment of the present invention.
Figure 2:
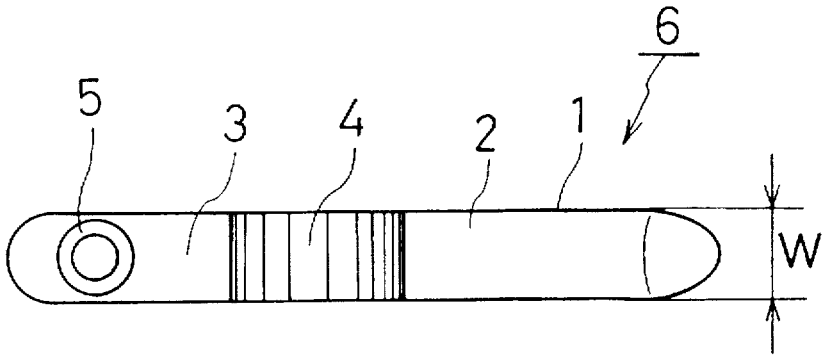
FIG. 2 is a plane view of a metal base of the embodiment of the present invention.
Figure 6:
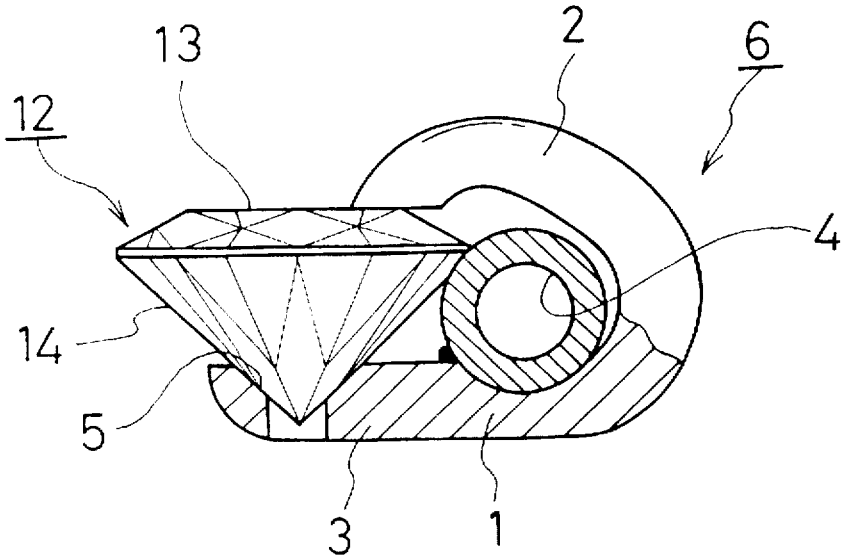
FIG. 6 is a partially broken side view of an accessory of the present invention.
Figure 7:
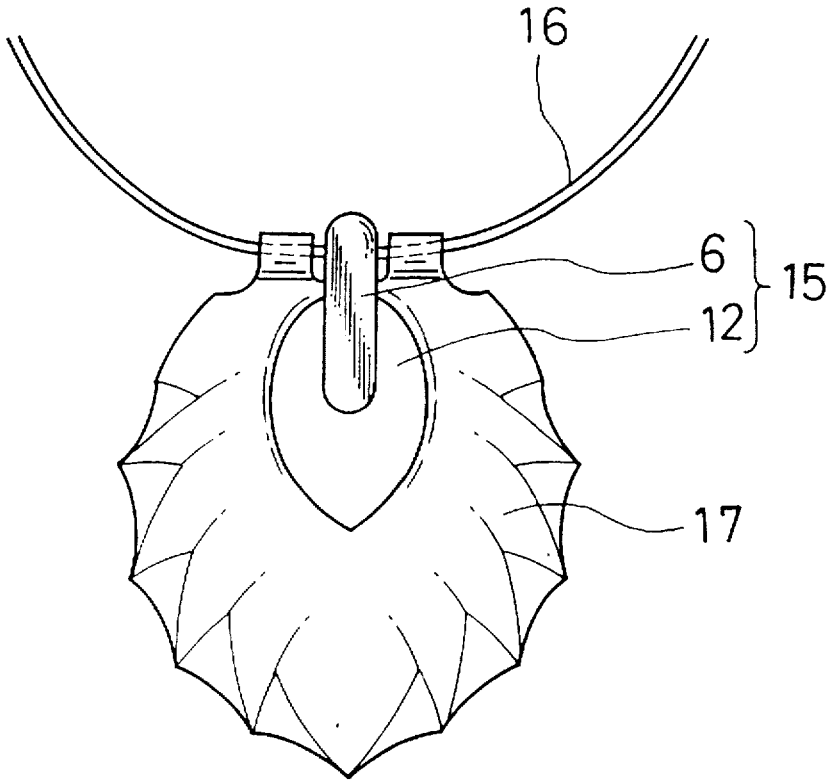
FIG. 7 is a front view of a necklace making use of an accessory of the present invention.

About the metal mount of the present invention, its embodiments are explained referring to FIGS. 1, 2 and 6.

The metal mount 6, as shown in FIG. 6, comprises a narrowed width w of a metal base 1 with a laterally viewing U-letter figured shape having an upper leg portion 2 and a lower leg portion 3, and on the tip end of the lower leg portion 3 opposing to the upper leg portion 2 is provided a hole 5 to form a bed for a conical end of a jewel 12, and inside the curved portion of the laterally viewing U-letter figured shape of the metal base a cylinder 4 is mounted in a unitary manner to abut to the side of the conical portion of the jewel.

The metal mount 6, as shown in FIGS. 1 and 2, is processed by starting initially to fix by welding the cylinder 4 having a width dimension identical or smaller than the one of a straight stretched strip of metal on an upper surface thereof, subsequently to fold it based on the cylinder 4 like a U-shape in such a manner the upper leg portion 2 opposes to the lower leg portion 3. That is, the lower leg portion is kept straight, the upper leg portion 2 is bent.

Figure 3:
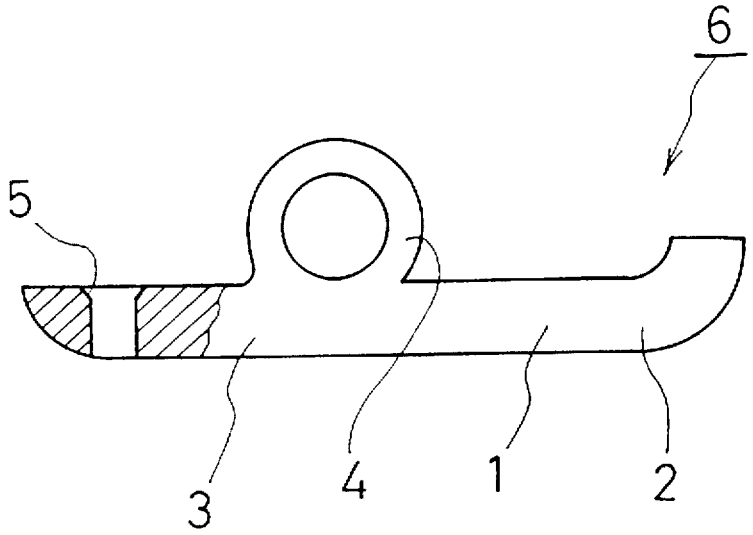
FIG. 3 is a side view of a metal base of another embodiment of the present invention.
Figure 4:
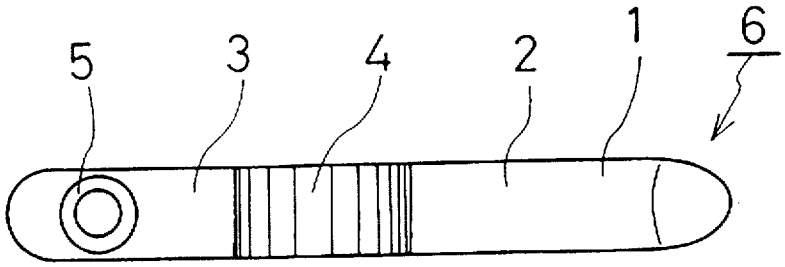
FIG. 4 is a plane view of FIG. 3.
Figure 5:
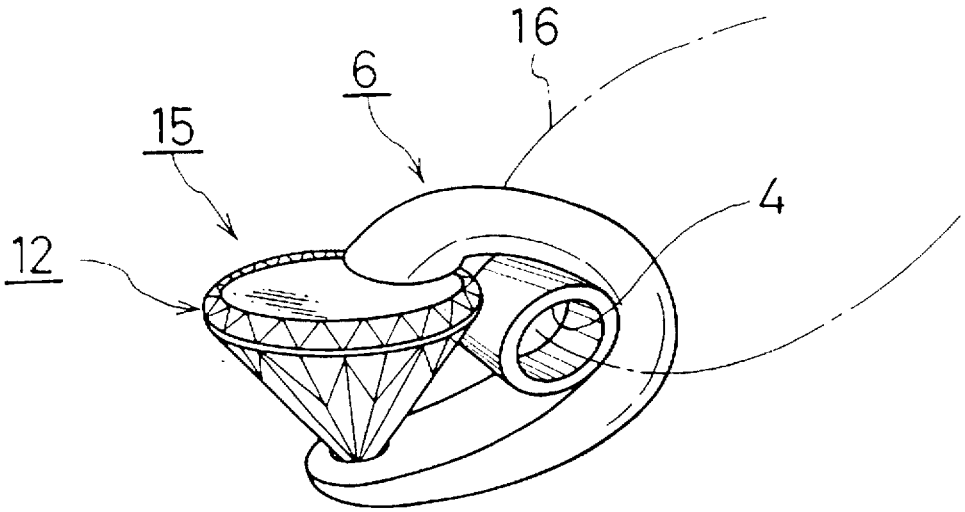
FIG. 5 is a perspective view of an accessory of the present invention.

The cylinder 4 may be processed, as shown in FIGS. 3 and 4, by being formed from one metal member.

In order to form an accessory, the jewel 12 is set between the upper leg portion 2 and the lower leg portion 3 of the mount metal 6. In this case, a jewel is cut in the fashion of so-called brilliant cutting, and the upper surface of the jewel is a plane 13 called table, and the lower surface of the jewel is tapered end like a pyramidal or conical, so-called pavilion 14 (hereinafter referred to "conical portion"). The tip end of conical portion 14 is called a culet.

Setting of the jewel 12 is carried out, as shown in FIGS. 1 and 6, by inserting the culet of the jewel into the conical portion of the hole 5 pierced inside of the lower leg portion 3, making the conical portion 14 of the jewel abut to the outside of the cylinder 4 and bending the upper leg portion 2 by using such as a hand press to abut the upper leg portion 2 to the end of the plane 13 of the jewel.

As an accessory 15, in addition to the above it is used in such a manner as a string-like 16 is inserted into the cylinder 4, and since the metal base 1 is narrow in its width, an ornamentation 17 is easily attached upon necessity, to the accessory by making use of a string-like 16.

As the present invention is constructed as the above, the metal mount for jewels in which jewels are mounted firmly and the accessories which are formed by mounting the jewels on said metal mount can be provided, in addition there is no necessity of preparing the metal base for each specific jewel according to the size and shape of the jewels. Thereby, since the manufacturing of such accessories become easy and fast, the efficiency of the production is increased and the cost down is realized.

Further, the jewel is clamped between the upper leg portion and the lower leg portion and the conical portion thereof abuts to the outside of the cylinder, in addition, the upper leg portion abuts to the upper plane eccentrically in its off-center position, so that the fitting of the jewel becomes stable and the most part of the central plane of the jewel is adapted to be exposed to increase an esthetic impression. Further, as to the cylinder having a length identical or small dimension in comparison with the width of the metal base, it will contribute to support the jewel and to carry out easy manufacturing by making use for inserting a string-like.

What is claimed is:

1. A metal mount for cut jewels having a plane portion on upper surface and a conical portion on the lower surface, which consists of a strip of metal base having narrowed width and a laterally viewing U-letter figured shape with an upper leg portion and a lower leg portion, on the inside end of the lower leg portion opposing the upper leg portion is provided with a hole in which the conical tip of the conical portion of the cut jewel is to be inserted, and on the inside of the laterally U-letter curved portion a cylinder is provided in a unitary manner to be in contact with the conical portion of the cut jewel.

2. An accessory which comprises a laterally viewing U-letter figured shape of strip of metal base with an upper leg portion and a lower leg portion, on the inside of the tip end of the lower leg portion a hole is provided and a cylinder is provided on the inside of the curved portion of the metal base to form a metal mount, and a cut jewel being fit in the hole of the lower leg portion with its tip end of the conical portion and under the inner surface of the upper leg portion with its upper plane portion, while the side of the conical portion being in contact with the cylinder.

3. A jewelry article comprising:

a mount; and a cut jewel supported in the mount, the cut jewel having a plane portion on an upper surface, a conical portion on a lower surface and an inclined portion between the plane portion and the conical portion, the mount comprising a base having a C-shape with an upper leg, a lower leg and a central portion between the upper and lower legs, the lower leg having a depression receiving a conical tip of the conical portion of the cut jewel, and the upper leg having a contact portion contacting the plane portion of the cut jewel such that the cut jewel is located within the C-shaped base between the upper and lower legs;

the central portion including an opening with a periphery, the periphery having a bearing portion bearing against the conical portion of the cut jewel.

4. A jewelry article comprising:

a mount; and a cut jewel supported in the mount, the cut jewel having a plane portion on an upper surface, a conical portion on a lower surface and an inclined portion between the plane portion and the conical portion, the mount comprising a base having a C-shape with an upper leg, a lower leg and a central portion between the upper and lower legs, the lower leg having a depression receiving a conical tip of the conical portion of the cut jewel, and the upper leg having a contact portion contacting the cut jewel such that the cut jewel is located within the C-shaped base between the upper and lower legs;

the central portion including an opening with a periphery, the periphery having a bearing portion bearing against only a portion of the conical portion of the cut jewel in a longitudinal direction of the cut jewel.

5. A mount for cut jewels having a plane portion on an upper surface, a conical portion on a lower surface and an inclined portion between the plane portion and the conical portion, the mount comprising:

a base having a C-shape with an upper leg, a lower leg and a central portion between the upper and lower legs, the lower leg having a depression for receiving a conical tip of the conical portion of the cut jewel, and the upper leg having a contact portion for contacting the plane portion of the cut jewel such that the cut jewel can be located within the C-shaped base between the upper and lower legs, the contact portion being substantially parallel to the lower leg;

the central portion including an opening with a periphery, the periphery having a bearing portion for bearing against the conical portion of the cut jewel.

6. A mount for cut jewels having a plane portion on an upper surface, a conical portion on a lower surface and an inclined portion between the plane portion and the conical portion, the mount comprising:

a base having a C-shape with an upper leg, a lower leg and a central portion between the upper and lower legs, the lower leg having a depression for receiving a conical tip of the conical portion of the cut jewel, and the upper leg having a curved portion for contacting the cut jewel such that the cut jewel can be located within the C-shaped base between the upper and lower legs;

the central portion including an opening with a periphery, the periphery having a bearing portion for bearing against the conical portion of the cut jewel.

7. A mount for cut jewels having a plane portion on an upper surface, a conical portion on a lower surface and an inclined portion between the plane portion and the conical portion, the mount comprising:

a base having a C-shape with an upper leg, a lower leg and a central portion between the upper and lower legs, the lower leg having a depression for receiving a conical tip of the conical portion of the cut jewel, and the upper leg having a contact portion for contacting the cut jewel such that the cut jewel can be located within the C-shaped base between the upper and lower legs;

the central portion including an opening with a periphery for facing the conical portion of the cut jewel and extending between the upper and lower legs, the periphery having a bearing portion for bearing against the conical portion of the cut jewel, the bearing portion having a length less than a length of the periphery extending between the upper and lower legs.

* * * * *